United States Patent [19]

Gueret

[11] Patent Number: 4,884,912

[45] Date of Patent: Dec. 5, 1989

[54] MAKE-UP APPLICATOR HAVING A REPLACEABLE PRODUCT CARTRIDGE

[75] Inventor: Jean-Louis H. Gueret, Paris, France

[73] Assignee: L'Oreal, Paris, France

[21] Appl. No.: 908,202

[22] Filed: Sep. 17, 1986

[30] Foreign Application Priority Data

Oct. 3, 1985 [FR] France ..... 8514667

[51] Int. Cl.[4] ..... A45D 40/00; A45D 40/04; A45D 40/18

[52] U.S. Cl. ..... 401/78; 401/86; 401/68

[58] Field of Search ..... 401/78, 86, DIG. 1, 401/68; 132/88.7

[56] References Cited

U.S. PATENT DOCUMENTS

| | | | |
|---|---|---|---|
| 2,000,701 | 5/1935 | Janer | 401/86 X |
| 2,443,361 | 6/1948 | Satz et al. | 401/59 |
| 2,629,488 | 2/1953 | See | 401/78 |
| 2,797,803 | 7/1957 | Hopgood | 401/78 X |
| 2,840,229 | 6/1958 | Hopgood . | |
| 2,982,397 | 5/1961 | Wahle . | |
| 3,323,641 | 6/1967 | Landen | 401/86 |
| 3,346,103 | 10/1967 | Swenson | 132/88.7 |
| 3,623,821 | 11/1971 | Gould . | |
| 3,653,776 | 4/1972 | Geisel . | |
| 3,991,777 | 11/1976 | Powers | 132/88.7 |
| 4,311,402 | 1/1982 | Brown | 401/78 |
| 4,579,134 | 4/1986 | Moore | 401/78 |
| 4,603,989 | 8/1986 | Ackerman | 401/78 |

FOREIGN PATENT DOCUMENTS

| | | |
|---|---|---|
| 901636 | 8/1945 | France . |
| 1152702 | 2/1958 | France . |
| 1518889 | 3/1968 | France . |
| 2074939 | 10/1971 | France . |
| 2393547 | 1/1979 | France . |
| 2574640 | 2/1987 | France . |
| 314497 | 6/1956 | Switzerland . |
| 325307 | 10/1957 | Switzerland . |
| 853306 | 11/1960 | United Kingdom . |
| 159960 | 10/1981 | United Kingdom . |
| 2115387 | 9/1983 | United Kingdom . |

*Primary Examiner*—Steven A. Bratlie

*Attorney, Agent, or Firm*—Cushman, Darby & Cushman

[57] ABSTRACT

An applicator for lipstick comprises means for fastening (a) the base member of the inner tubular casing of the assembly forming the displacement actuating assembly, to (b) the base of an outer case to be held by the operator, so that the base member and base execute conjoint rotation. The fastening means comprise a jacket arranged between the inner tubular casing and the base.

15 Claims, 2 Drawing Sheets

MAKE-UP APPLICATOR HAVING A REPLACEABLE PRODUCT CARTRIDGE

FIELD OF THE INVENTION

The present invention relates to an applicator for applying a pasty product, especially a cosmetic product such as lip make-up, in stick form.

PRIOR ART

Containers for a stick of pasty product, such as lip make-up, generally comprise coaxial inner and outer tubular casings interacting by relative rotation to drive a plunger having a socket intended to receive the stick of product. Such containers additionally comprise a base which is integrally attached to a base member of the inner tubular casing for rotation therewith, and a cap fitting over the outer tubular casing and abutting the base. For aesthetic reasons in particular, the cap and the base are made of finer materials than the tubular casings in order to form decorative features; they therefore constitute a major item contributing to the cost of the container. When all the pasty product has been used up, it is possible to replace the assembly consisting of the tubular casings the plunger and the stick, whereas the cap and the base are retained. The user herself, or himself, will therefore need to separate the base from the base member of the inner tubular casing, and then to equip this same base with a refill set. These operations must be capable of being performed simply and repeatedly, without the risk of damage either to the base or to the assembly and, furthermore, the operation of fitting together the base and the base member in the inner tubular casing for conjoint rotation must be performed securely, as otherwise the plunger would not be driven to move in the appropriate fashion.

One solution which has since become traditional is described in FR-A-2,393,547, in which the container comprises means for fastening the base member of the inner tubular casing to the base, such means consisting of (a) a conduit opening into a bottom wall of the base member, the walls of this funnel being spaced from the side walls of the base member, and (b) a member enabling the base to be force-fitted into this conduit.

Another solution is described in French patent application No. 8419335 (L'Oreal) which discloses such a lip make-up container comprising an inner tubular casing having on its outer wall, near the end opposite the end at which the stick emerges, resilient abutment means capable of bearing against the neighbouring edge of the outer tubular casing and/or of the metal jacket; these abutment means push this outer tubular casing in a direction parallel to the axial direction against abutment means provided at the other end.

Because of the variations in the size of the components of these devices, especially of the inner and outer tubular casings, unavoidable in a manufacturing process, the manufacturing tolerances result in relatively large clearances, especially extending parallel to the axial direction, between the inner and outer tubular casings. The device is then relatively loose and, as a result of the clearances which are present, the inner tubular casing can easily move relative to the outer tubular casing; this results in imprecise control of the movement of the stick of pasty product.

The solutions described above have been proposed in order to reduce this disadvantage, but they are not entirely satisfactory.

OBJECT OF THE INVENTION

The object of the invention is, above all, to provide a device for applying a pasty product, of the type defined above, which better satisfies the various practical requirements and which, in particular, no longer involves the disadvantage recalled above, or does so only to a minute degree. It is furthermore desirable that a device of this kind should be simple and economic to manufacture and should operate in a manner which the users can regard as smooth.

SUMMARY OF THE INVENTION

According to the present invention, we provide an applicator for a pasty product, especially a cosmetic product such as lip make-up, comprising: an inner tubular casing which comprises a base member and at least one slide; a plunger mounted slidingly in said inner tubular casing and intended to receive the product stick, said plunger having at least one stud engaged in said slide; an outer tubular casing coaxial with the inner tubular casing and abutting said base member thereof, said outer tubular casing having a wall comprising at least one helical groove corresponding to the slide, the or each stud of the plunger being engaged in the or a respective said helical groove; an optional outer jacket, preferably metallized, covering the outer tubular casing; a base which is fastened in rotation to means for fastening the base member to the inner tubular casing; and a cap covering the outer tubular casing, and the optional outer jacket if appropriate, and bearing on the base; characterized in that the means for fastening the base member to the inner tubular casing comprise a jacket between the base member of said inner tubular casing and the base.

This jacket surrounds the part of the outer tubular casing abutting the base member of the inner tubular casing, and which may be covered by the optional outer jacket.

This applicator for a pasty product may additionally comprise a ballast which is arranged between the base and the bottom of the base member.

This ballast may advantageously comprise a projection which passes through the bottom of the base member substantially in its central region and is equipped with peripheral antirotation striations.

In a first embodiment of the present invention, the base comprises an annular projection forming an abutment within which projection the ballast is arranged and fastened by an appropriate means for conjoint rotation therewith.

This ballast preferably comprises two diametrically opposed studs which interact with two cavities situated in the corresponding wall of the abutment-forming annular projection.

In this embodiment, the jacket comprises a lateral skirt extended by an annular portion bearing on the abutment-forming annular projection.

In a second embodiment, this jacket comprises a lateral skirt which is extended by an annular portion situated between the bottom of the base and the ballast, and which comprises a retaining ring at the level of the bottom of the base member.

In this case, the means fastening the ballast and the base comprises peripheral antirotation striations of this ballast.

BRIEF DESCRIPTION OF THE DRAWINGS

In order that the present invention may more readily be understood the following description, which is not limiting in any way in its nature, is given and should be read in conjunction with the accompanying drawings, in which.

Figure 1:
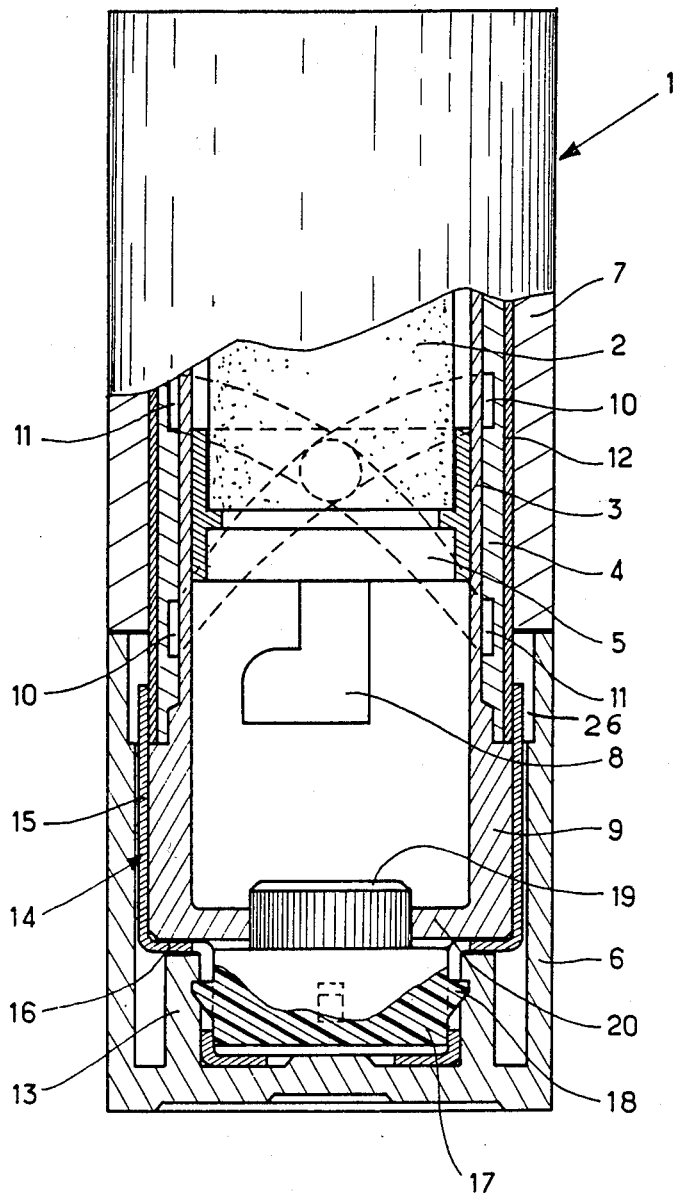
FIG. 1 shows, in partial cross-section, a first embodiment of the device of the invention.

Referring now to the drawings, these show a device 1 for applying a pasty product, especially lip make-up, presented in the form of a stick 2.

DESCRIPTION OF THE PREFERRED EMBODIMENTS

As already described above, this device comprises an inner tubular casing 3 and a coaxial outer tubular casing 4, which interact by relative rotation. A plunger 5 supports the stick 2 of pasty product. A base 6 and a cap 7 cover the outer tubular casing 4 and the cap 7 abuts the base 6.

The inner tubular casing 3 comprises two diametrically opposed L-shaped slides of which only one, the slide 8 can be seen in the Figures. This inner tubular casing 3 comprises a base member 9 formed by a localised thickening of its wall. Mounted slidingly in this inner tubular casing 3 is the plunger 5 which is intended to receive the product stick 2 and is equipped with two studs (not shown in the drawings) engaged in the slides.

The outer tubular casing 4 is coaxial with the inner tubular casing 3 and abuts its base member 9; the wall of the outer tubular casing comprises two diametrically opposed helical grooves 10, 11 in which the above-mentioned studs of the plunger 5 also engage. Thus, when the inner and outer tubular casings 3 and 4, respectively, rotate relative to each other the plunger 5 is driven lengthwise in the inner tubular casing 3.

If desired, an optional outer jacket 12, which may for example be metallized, can cover the outer tubular casing 4.

The base 6 is fastened for conjoint rotation with the inner tubular casing 3 by means which connect the base member 9 for rotation therewith.

When all the pasty product of the stick 2 has been used up, the assembly consisting of the inner tubular casing 3, its base member 9, and the plunger 5, is disconnected from the outer tubular casing 4 fastened integrally to the metallized or metallic outer jacket 12, and is then pulled out to enable it to be replaced with an identical assembly.

In the first embodiment shown in FIG. 1, the base 6 comprises an annular projection 13 forming an abutment on which the base member 9 of the inner tubular casing 3 bears indirectly.

In this case the means for fastening the base member 9 to the base 6 for conjoint rotation include a jacket 14 which is arranged between the base member 9 of the inner tubular casing 3 and the base 6 and which comprises a skirt 15 extended by an annular portion 16 which bears on the abutment-forming annular projection 13 of the base 6.

A device 1 of this kind may also comprise ballast 17 which is then situated in the space bounded by the abutment-forming annular projection 13. This ballast 17 may be integrally fastened to the base 6 for rotation therewith by means of two diametrically opposed studs 18 interacting with two corresponding cavities situated in the wall of the abutment-forming annular projection 13 to fix the ballast 17 against rotation relative to the base 6.

This ballast may also comprise a projection 19 which passes through the bottom 20 of the base member 9 substantially in its central region; this projection 19 is equipped with peripheral antirotation striations to lock the ballast 17 also against rotation relative to the base member 9.

The skirt 15 of the jacket 14 extends over the entire height of the base member 9 and even overlaps the part of the outer tubular casing 4, resting on the base member 9 of the inner tubular casing 3, and which may if desired be covered with an outer jacket 12.

By virtue of this jacket 14, which is thus sandwiched between the base member 9 and the base 6, the base 6 can drive rotationally the inner tubular casing 3 within the outer tubular casing 4. In this case, the projection 19 of the ballast 17 functions only as an antirotation device, although the ballast is itself driven in rotation by the base 6.

It should be noted that, in the region of the outer jacket 12, the base 6 is very slightly set back to create the small for recess 26 in this manner between the base 6 and the jacket 14 for ensuring that the firmness of the braking will not be disturbed by the possible pressure on the base 6 over the entire corresponding height of the outer jacket 12.

Figure 2:
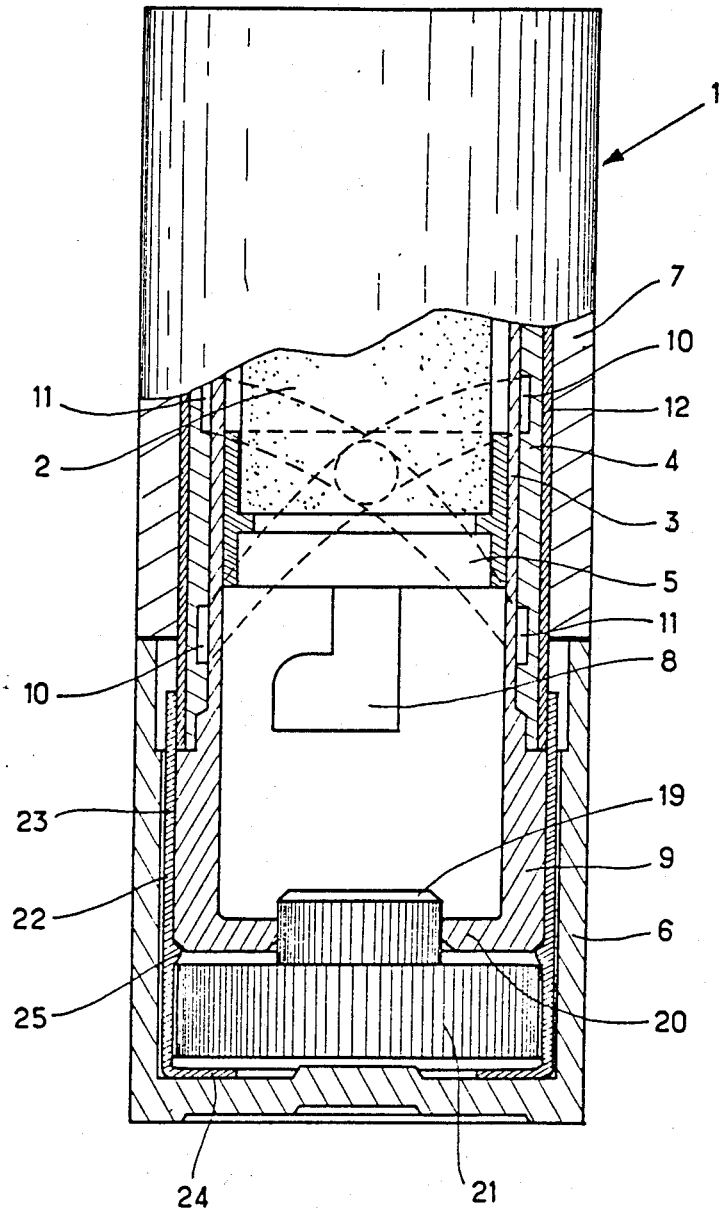
FIG. 2 shows, in partial cross-section, a second embodiment of the device of this invention.

A second embodiment is shown in FIG. 2, in which those components which are strictly identical to those of FIG. 1 are marked by the same reference numerals. In this second embodiment, the device 1 comprises a ballast 21 whose diameter is substantially equal to the inner diameter of this base 6. This ballast 21 which is thus situated under the bottom 20 of the base member 9 may also comprise an antirotation projection 19 which passes through this bottom substantially in the central region of the latter and which is equipped with peripheral striations.

In this case, the means for fastening the base 6 for conjoint rotation with the base member 9 of the inner tubular casing 3 consist of a jacket 22 which comprises a lateral skirt 23 extended by a portion 24 beneath the ballast 21. At the level of the bottom 20 of the base member 9, this lateral skirt 23 comprises a retaining ring 25 on which this bottom 20 of the base member 9 rests.

This retaining ring 25 thus forms an abutment when a refill mechanism is pushed into the base 6.

Just as in the preceding embodiment, the rotation of the base 6 also drives the inner tubular casing 3 due to the fact that the lateral skirt 23 of the jacket 22 is wedged between the base member 9 and this base 6. Similarly, the ballast 21 functions only as an antirotation device even though it can be driven rotationally by the base 6.

Just as before, a small clearance may exist between the base 6 and the lateral skirt 23 in the region where the outer tubular casing 12 is overlapped by the skirt 23.

The jacket 14 or 22 is advantageously made of a polyethylene so as to be capable of (a) resiliently conforming to the base member 9 of the inner tubular casing 3, (b) covering, if desired, the part of the outer tubular casing 4 which may or may not be covered by an outer jacket 12, and (c) being compressed between the base member 9 and the base 6. This arrangement thus provides a smooth rotation of the inner tubular casing 3 and retains the stick of lip make-up securely in an exposed position, even during use.

I claim:

1. An applicator for a pasty product in stick form, comprising:

(a) an inner tubular casing;

(b) means defining at least one slide to said inner tubular casing;

(c) a base member to said inner tubular casing;

(d) a plunger adapted to receive a stick of the pasty product;

(e) means slidingly mounting said plunger in said inner tubular casing for movement therealong;

(f) stud means to said plunger, said stud means being engaged in said at least one slide;

(g) an outer tubular casing coaxial with said inner tubular casing, said outer tubular casing having a part abutting said base member of the inner tubular casing;

(h) a wall to said outer tubular casing;

(i) means defining at least one helical groove in said wall, said at least one groove being associated with and adjacent said slide, said stud means of the plunger being engaged in said at least one helical groove;

(j) a base outside said base member of the inner tubular casing;

(k) means fastening said base to said inner tubular casing for conjoint rotation with the inner tubular casing and its base member; and (1) a cap covering the outer tubular casing and abutting said base;

wherein said fastening means comprise a jacket arranged between the base member of said inner tubular casing and said base, and said applicator additionally comprising ballast means arranged between said base and the bottom of said base member;

said jacket surrounding said part of the outer tubular casing which abuts said base member of the inner tubular casing, thus exerting a braking pressure on said outer tubular casing, said base, adjacent said outer tubular casing including a recess providing a clearance between said base and said jacket assuring that the force of the braking will not be effected by pressure of said outer tubular casing on said base.

2. An applicator according to claim 1, wherein said ballast means comprises a projection passing through the said bottom, substantially in the middle region of said bottom, said projection including antirotation striation means at its periphery.

3. An applicator according to claim 2 wherein said base has an annular projection and said jacket comprises a lateral skirt and an annular portion formed as an extension of said lateral skirt and abutting said annular projection of the base.

4. An applicator according to claim 2, wherein said jacket comprises a lateral skirt and a jacket portion formed as an extension of said skirt and situated between the bottom of the base and the ballast means, said jacket portion comprising a retainer ring at the level of the bottom of said base member.

5. An applicator according to claim 1, wherein said base comprises annular projection means forming an abutment for said jacket, said ballast means being positioned within said annular projection means; and including means fastening said ballast means to said annular projection means for conjoint rotation therewith.

6. An applicator according to claim 5, wherein said annular projection means includes two diametrically opposed cavity means, and said ballast means comprises two diametrically opposed studs co-operating with said cavity means.

7. An applicator according to claim 1, wherein said jacket is made of polyethylene.

8. An applicator according to claim 1, and further including an outer jacket covering said outer tubular casing.

9. An applicator according to claim 8, wherein said outer jacket surrounds said part of the outer tubular casing which abuts said base member of the inner tubular casing, and wherein the first-mentioned jacket surrounds both said outer jacket and said part of the outer tubular casing which abuts said base member of the inner tubular casing, thus exerting a clamping pressure on the outer tubular casing and the outer jacket.

10. An applicator according to claim 1, wherein said ballast means comprises a projection passing through the said bottom, substantially in the middle region of said bottom, said projection including antirotation striation means at its periphery.

11. An applicator according to claim 10, wherein said base has an annular projection and said jacket comprises a lateral skirt and an annular portion formed as an extension of said lateral skirt and abutting said annular projection of the base.

12. An applicator according to claim 10, wherein said jacket comprises a lateral skirt and a jacket portion formed as an extension of said skirt and situated between the bottom of the base and the ballast means, said jacket portion comprising a retainer ring at the level of the bottom of said base member.

13. An applicator according to claim 1, wherein said base comprises annular projection means forming an abutment for said jacket, said ballast means being positioned within said annular projection means; and including means fastening said ballast means to said annular projection means for conjoint rotation therewith.

14. An applicator according to claim 13, wherein said annular projection means includes two diametrically opposed cavity means, and said ballast means comprises two diametrically opposed studs co-operating with said cavity means.

15. An applicator according to claim 8, wherein said jacket is made of polyethylene.

* * * * *